US010852112B2

(12) United States Patent
Solberg et al.

(10) Patent No.: US 10,852,112 B2
(45) Date of Patent: Dec. 1, 2020

(54) METHOD AND SYSTEM FOR PROTECTING FOLDING WINGS ON A MISSILE WHILE IN THEIR STOWED STATE

(71) Applicant: KONGSBERG DEFENCE & AEROSPACE AS, Kongsberg (NO)

(72) Inventors: Arnstein Solberg, Kongsberg (NO); Jens A. Gjestvang, Asker (NO); Trond Henning Sleveland, Vestfossen (NO); Kristian Jensrud, Oslo (NO); Ivar Thomle Hoelsæter, Notodden (NO)

(73) Assignee: KONGSBERG DEFENCE & AEROSPACE AS, Kongsberg (NO)

( * ) Notice: Subject to any disclaimer, the term of this patent is extended or adjusted under 35 U.S.C. 154(b) by 403 days.

(21) Appl. No.: 15/525,225

(22) PCT Filed: Nov. 7, 2014

(86) PCT No.: PCT/EP2014/074020

§ 371 (c)(1),
(2) Date: May 8, 2017

(87) PCT Pub. No.: WO2016/070930

PCT Pub. Date: May 12, 2016

(65) Prior Publication Data

US 2017/0328692 A1 Nov. 16, 2017

(51) Int. Cl.

| | |
|---|---|
| ***F42B 10/16*** | (2006.01) |
| ***F42B 10/46*** | (2006.01) |
| ***F42B 15/10*** | (2006.01) |
| ***F42B 15/36*** | (2006.01) |
| ***F42B 10/42*** | (2006.01) |

(Continued)

(52) U.S. Cl.

CPC ..... *F42B 10/16* (2013.01); *F42B 10/42* (2013.01); *F42B 10/46* (2013.01); *F42B 15/10* (2013.01); *F42B 15/36* (2013.01); *F42B 10/00* (2013.01); *F42B 15/00* (2013.01)

(58) Field of Classification Search

CPC ..... F42B 10/14; F42B 10/16; F42B 10/18; F42B 10/20; B64C 3/56

See application file for complete search history.

(56) References Cited

U.S. PATENT DOCUMENTS

| | | | |
|---|---|---|---|
| 3,114,287 | A | 12/1963 | Seaim |
| 3,273,500 | A | 9/1966 | Sverre |

(Continued)

FOREIGN PATENT DOCUMENTS

| | | | |
|---|---|---|---|
| DE | 30 27 438 | A1 | 2/1982 |
| EP | 1 211 475 | A2 | 6/2002 |

(Continued)

OTHER PUBLICATIONS

International Search Report, dated Jul. 7, 2015, from corresponding PCT application.

*Primary Examiner* — Nicholas McFall
*Assistant Examiner* — Terri L Filosi
(74) *Attorney, Agent, or Firm* — Nixon & Vanderhye

(57) ABSTRACT

A cover 10 and method for protecting a missile 15 with stowed wings 20 and connected to a vessel carrying it. The cover 10 includes a spoiler shaped front part 25 for covering a gap between the wings 20 of the missile 15 and the fuselage of the missile 15 for minimizing aerodynamic forces.

18 Claims, 5 Drawing Sheets

(51) Int. Cl.
*F42B 10/00* (2006.01)
*F42B 15/00* (2006.01)

(56) References Cited

U.S. PATENT DOCUMENTS

| | | | | | |
|---|---|---|---|---|---|
| 4,488,491 | A * | 12/1984 | Rhodes | F42B 14/064 | 102/501 |
| 5,967,169 | A * | 10/1999 | Engel | B64D 33/02 | 137/15.1 |
| 6,392,213 | B1 * | 5/2002 | Martorana | B64C 39/024 | 244/13 |
| 8,403,253 | B1 * | 3/2013 | Cohen | F41J 9/08 | 102/513 |
| 2013/0291753 | A1 * | 11/2013 | Nikkei | F42B 10/16 | 102/473 |
| 2018/0170542 | A1 * | 6/2018 | White | H01Q 17/008 | |

FOREIGN PATENT DOCUMENTS

| | | | | |
|---|---|---|---|---|
| EP | 1211475 | A2 * | 6/2002 | F42B 15/01 |
| WO | 81/00908 | A1 | 4/1981 | |
| WO | 2009/051866 | A1 | 4/2009 | |

* cited by examiner

METHOD AND SYSTEM FOR PROTECTING FOLDING WINGS ON A MISSILE WHILE IN THEIR STOWED STATE

INTRODUCTION

The invention relates to a method and device for preventing vibrations or movements of missile wings exposed to air flow when these are in folded and stowed position. More specifically, the invention relates to a method for protecting a missile connected to a vessel carrying it, i.e. captive carriage, and to a cover serving as a protection and retention device for the missile wings as well as an air intake protection device for the missile.

BACKGROUND

Modern military vessels typically carry weapons such as unmanned aerial vehicles, missiles or cruise missiles that are jet powered and launched from the vessel at high speeds. Such missiles are typically equipped with wings that during captive carriage will be exposed to strong air flow resulting in forces and vibrations that necessitate a very strong mechanical design. For vessels like an aircraft at high speeds some missiles are typically carried in dedicated compartments in the fuselage of the aircraft.

To save space and cost some missiles can position their wings in a stowed position where the missile wings are folded alongside the missile such that a line going from the root of the wing to the tip will generally run in parallel to the missile body, either on top or on the side of the missile. Although such a construction will have fewer problems with vibrations it will also result in a more complicated mechanical construction.

Folding the wings down alongside the missile body such that a line from the root of the wing to the tip will point downwards can be an appropriate solution as it can lead to a relatively simple and strong mechanical construction in particular with regards to active flight. This solution will however suffer from strong forces induced by wind if the missile is to be carried as an external store. Wing covers used to protect wings during transport and storage must be removed before flight and have thus no effect on the vibration problem. Specially developed enforced wings on a missile for coping with strong air flow are expensive and will add to the total weight.

When designing a missile one will always try to minimize the volume needed during storage and "captive carry". It is therefore important to consider the concept of stowing in an early phase of design.

The present invention presents a solution to these problems. The invention is described by a mechanical device and a method for protecting the wings of a missile.

One object of the present invention is to protect the wings such that these will not vibrate or move when stowed and exposed to strong air flow.

By placing the air intake ducts on the side of the missile, instead of the more commonly used underneath placement, allows to use available space in front of the air intake ducts to stow the wings. This is advantageous because this volume in most cases cannot be used for anything else.

Another object of the invention is to protect the air intake of the jet engine of a missile. For doing this, the inventive device for holding the wings of the missile also serves as a cover for the air intakes such that air flowing through them does not cause the rotating parts therein to spin freely, possibly resulting in excessive wear to bearings.

Upon launch of a missile it is vital that the inventive cover covering the air intake and holding the wings of the missile is removed in a predictable and safe way so that it does not collide with the missile.

A further object of the invention is to provide a predictable and safe removal of the cover after launch of the missile. The cover and its holding mechanism have been designed to assure a predictable trajectory away from the missile when removed.

Safe and predictable removal of the cover is achieved by first releasing the front end of the cover and secondly the rear part of the cover. In this way the cover will rotate around the rear part thereby assuring that the first part of the movement away from the missile is strictly governed by the rear holding mechanism.

Short Description

The present invention is defined by a cover for protecting a missile with stowed wings and air intakes.

The cover comprises a front part, a bottom part, a rear part and suspension means. The front part covers a gap between the wings and the fuselage of the missile.

Further aspects of the cover are defined in the dependent claims.

The invention is also described by a method for protecting a missile with stowed wings and air intakes. The method is defined by:

- providing a cover comprising a front part, a bottom part, a rear part and suspension means, wherein said front part is shaped for covering a gap between the wings and the fuselage of the missile;
- folding the wings of the missile in a stowed configuration alongside the missile and in front of the air intakes, and
- mounting the cover on the missile by means of the suspension means such that the front part of the cover is covering a gap between the wings and the fuselage of the missile.

Further aspects of the method are defined in the dependent claims.

DETAILED DESCRIPTION

The invention will now be described in more detail with reference to the accompanying drawings where:

FIG. 1 visualizes the problem with vibration of missile wings due to strong air flow;

Figure 7A:
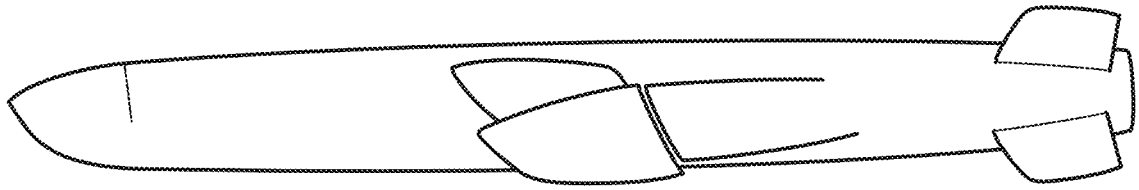
Figure 7B:
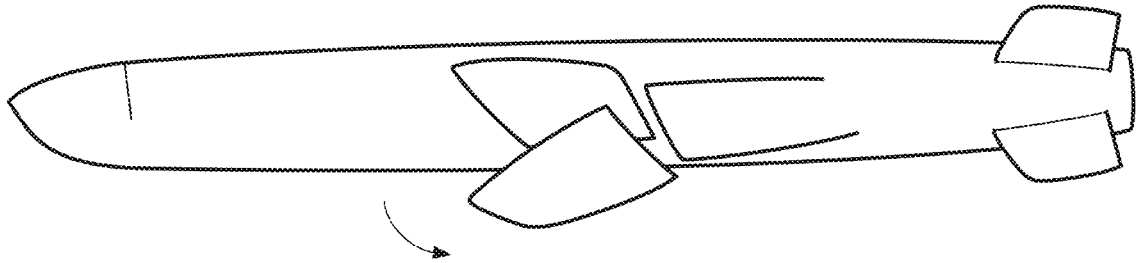
Figure 7C:
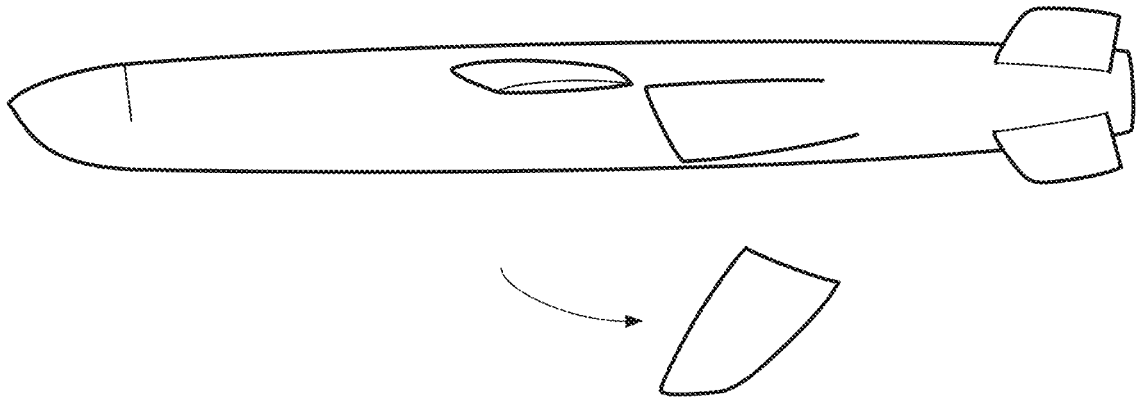

FIGS. 7A-C show phases with and without the cover.

Stowed wings on a missile are a usual configuration used for missiles carried by aircraft. These missiles may be carried in dedicated compartments in the fuselage, thus minimizing extra drag and protecting the missile, but this is not always a preferred configuration.

A missile can also be connected to a wing of an aircraft by means of pylons. For reducing wind forces acting on the wings of the missile the wings will typically be positioned in a stowed configuration where the wings are folded alongside the fuselage of the missile. Even though the wings of the missile are in a stowed position, a set of challenges such as unwanted aerodynamic effects will occur depending on the speed and movements of the aircraft.

Figure 1:
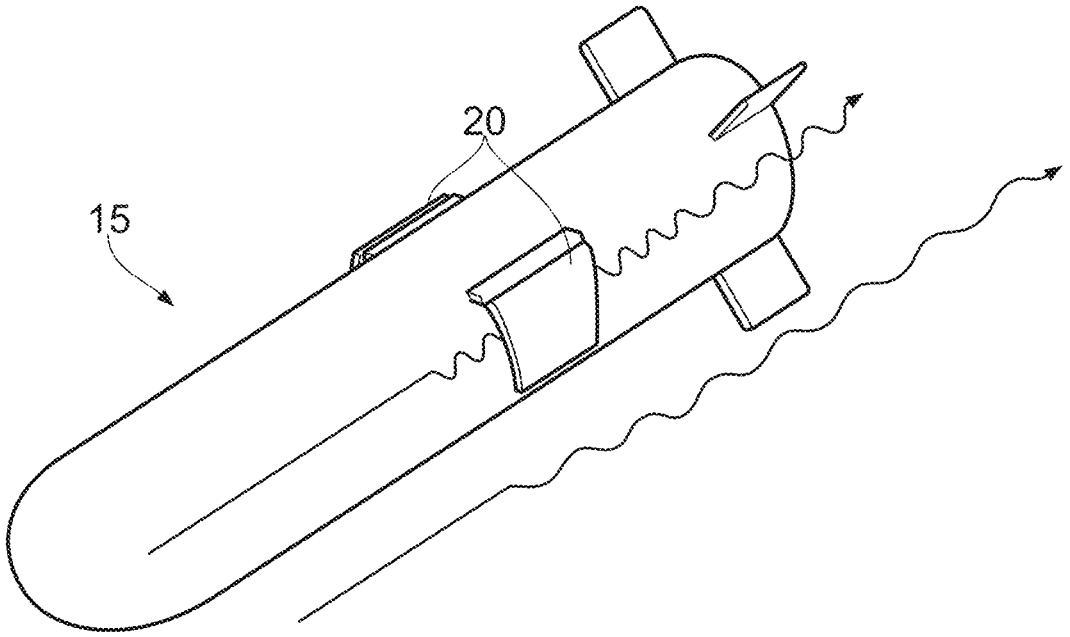

FIG. 1 visualizes the problem with vibration of the wings 20 of a missile 15 due to strong air flow between the fuselage of the missile 15 and its wings 20.

Figure 2A:
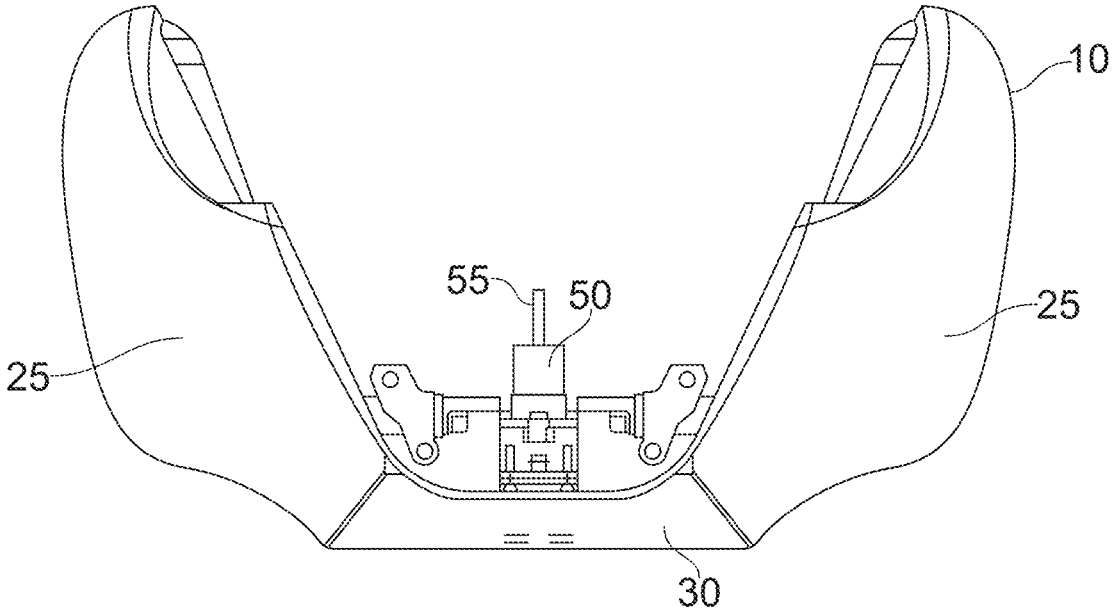
FIGS. 2A and 2B show a cover according to the invention.
Figure 2B:
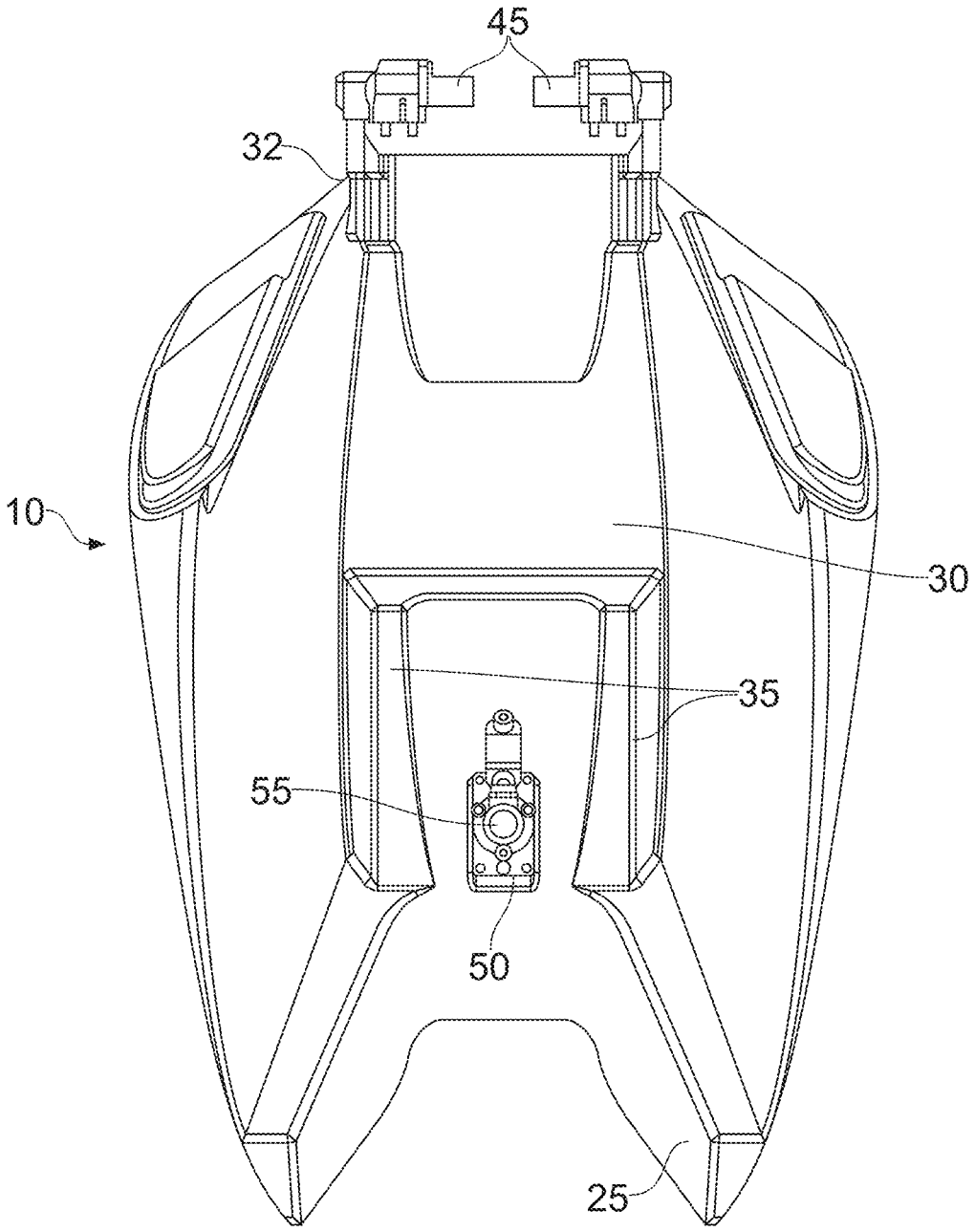

FIGS. 2A and B show a cover 10 according to the invention for providing a solution to said problem. FIG. 2A shows a front view of the cover 10, while FIG. 2B shows a top view of the cover 10.

The cover 10 can be made in any suitable material such as for instance a metal, metal alloy, plastic, carbon fiber or a combination of different materials.

The cover 10 provides protection of a missile 15 with stowed wings 20 and air intakes 40, the cover 10 comprises a front part 25, a bottom part 30, a rear part 32 and suspension means, wherein said front part 25 of the cover 10 is streamlined and angled in a direction upwards relative to said bottom part 30, and where the front part 25 covers a gap between the wings 20 and the fuselage of the missile 15 for minimizing aerodynamic forces acting on it. The bottom part 30 of the cover 10 is made with a shape similar to the top side of an aircraft wing profile for generating aerodynamic forces acting downwards on the cover 10 relative to the missile 15.

In one embodiment of the invention the bottom part 30 of the cover 10 comprises suspension means for the cover to the missile 15.

In a preferred embodiment of the cover, the front part 25 is shaped such that the air intakes 40 of the missile 15 is engaged with the cover thereby providing full protection of the air intakes 40.

In order to provide a predictable and safe removal of the cover 10 after launch of the missile 15, the cover 10 and its suspension mechanism have been designed to assure a predictable trajectory away from the missile 15 when removed.

According to one embodiment of the invention, the suspension means of the cover 10 for connecting the cover 10 to a missile 15 comprises two hinges 45 located at the rear part 32 of the bottom part 30 of the cover 10, and a ball-lock mechanism 55 is located closer to the front part 25 of the bottom part 30 of the cover 10. Only one hinge 45 or more than two hinges 45 that are located at the rear end are also feasible. The hinges 45 and the ball-lock mechanism 55 are connected to the missile 15 by corresponding engaging means mounted on the missile 15.

At least one of the suspension means comprises a release mechanism 50. In one embodiment this can be a forcing mechanism connected to the ball-lock mechanism 55 such that when the mechanism is released the front part of the cover 10 will be released and swing downwards. The ball-lock mechanism may be replaced by a magnetic or electro-magnetic mechanism.

Safe and predictable removal of the cover 10 is achieved by first releasing the front part 25 of the cover 10 and secondly the rear part 32 of the cover 10. In this way the cover 10 will rotate around the rear part 32 thereby assuring that the first part of the movement away from the missile 15 is strictly governed by the rear suspension mechanism.

In one embodiment of the invention the rear suspension mechanism is at least one hinge 45 that is designed with an open slot for releasing the cover 10 when it rotates away from the missile 15.

In one embodiment of the invention the cover 10 further comprises retention means 35 for holding the wings 20 in a folded and stowed position alongside the missile 15. This will further contribute to the protection of the wings 20 of the missile.

Different types of retention means 35 are possible. In one embodiment the retention means 35 is a slot comprised in the cover 10.

Figure 3:
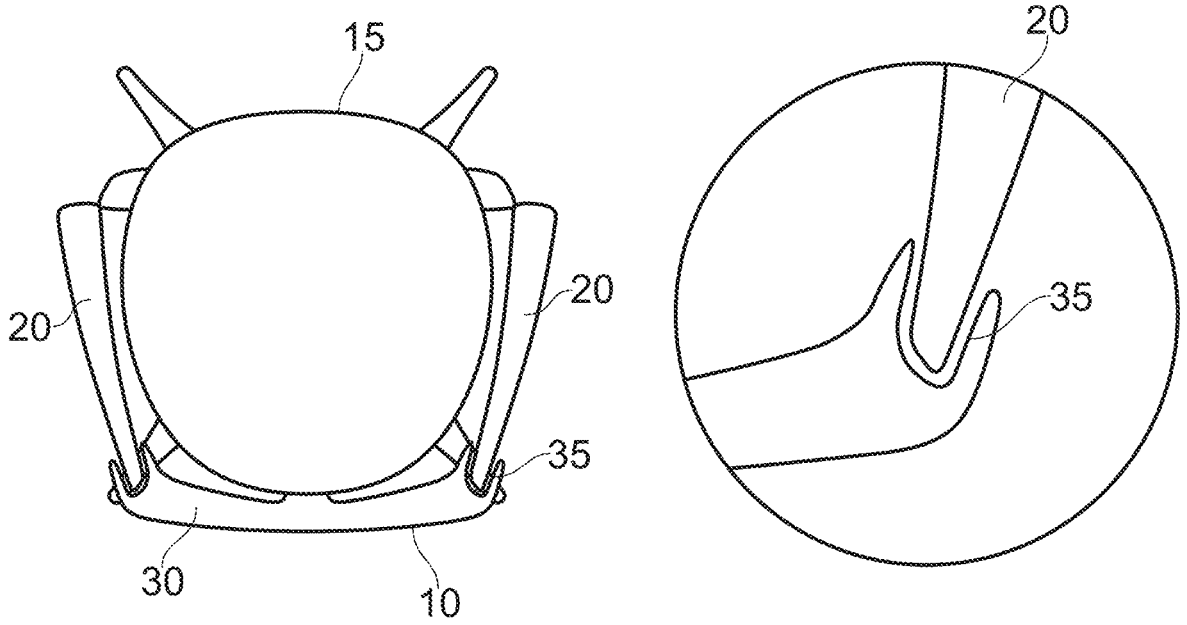
FIG. 3 shows retention means in the cover.

FIG. 3 illustrates a slot comprised in the cover 10 as the retention means 35 for the wings 20 of the missile 15. The figure illustrates the location of the slot and that the wings 20 are loosely placed in the retention means 35, i.e. the slot is wider than the width of the tip of the wing 20. Different embodiments of the retention means 35 are however feasible.

In one embodiment, the slot can for instance be covered by a soft material enclosing and firmly holding the tip of the wing 20.

In another embodiment the slot comprises a magnetic material for holding a magnetized tip of a wing 20 firmly in the channel or slot.

In yet another embodiment the retention means 35 can be other positioning or holding means other than a channel or slot. Examples of other means are one or more gripping arms or pins for keeping the wings 20 in a stable position.

Figure 4:
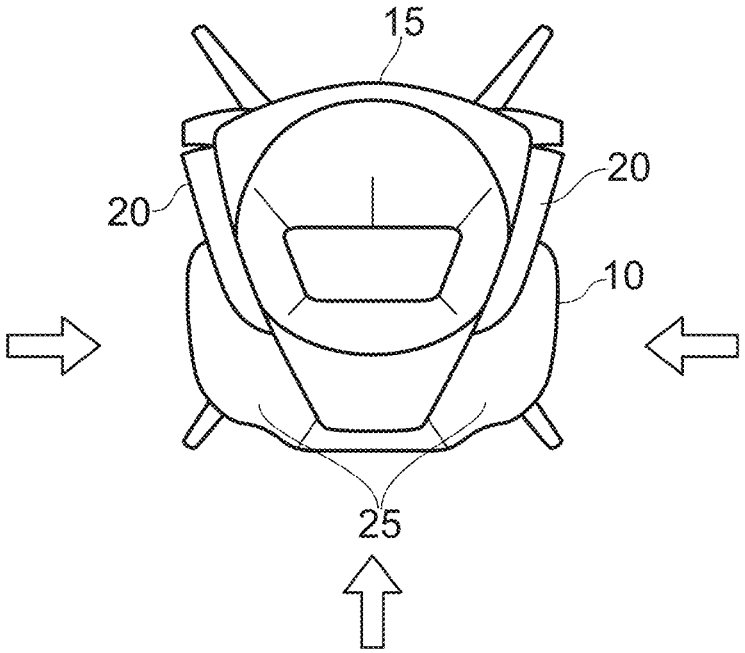
FIG. 4 shows the cover mounted to a missile with stowed wings.
Figure 5:
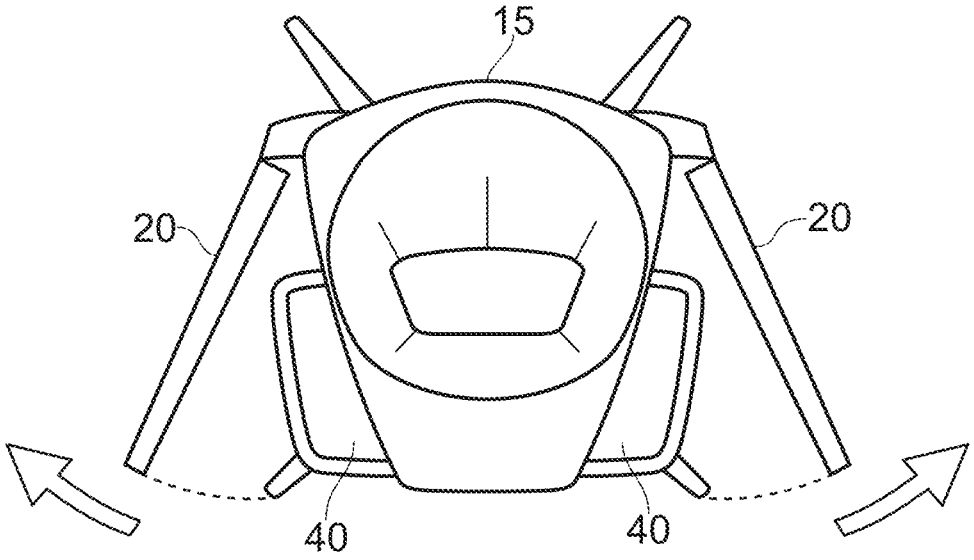
FIG. 5 shows the cover removed from a missile and wings unfolding.
Figure 6:
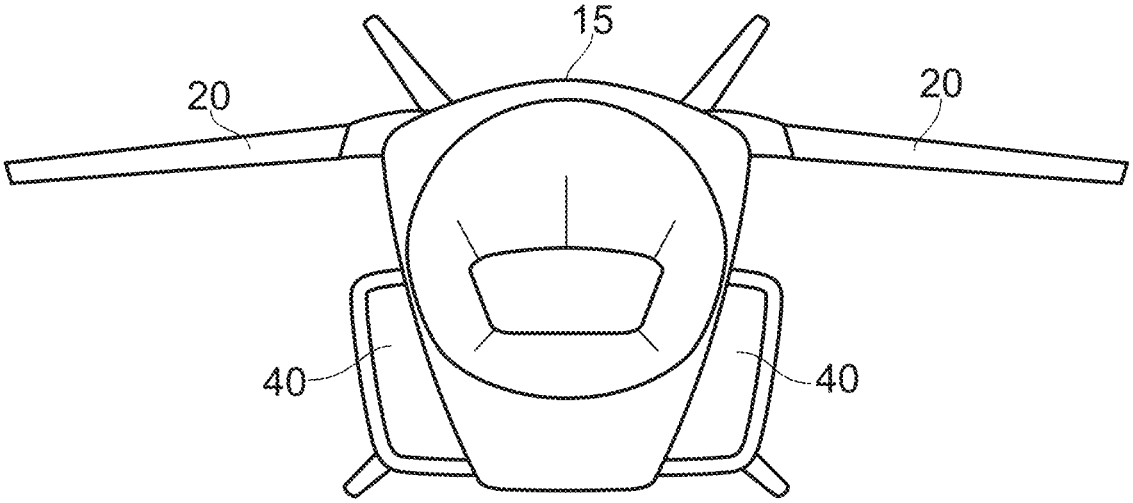
FIG. 6 shows an operating flying missile.

FIGS. 4 to 6 illustrate different operation phases of a missile 15 equipped with a cover 10 according to the present invention.

FIG. 4 illustrates the inventive cover 10 mounted to a missile 15. The figure shows that the cover 10 provides protection to stowed wings 20.

FIG. 5 illustrates the situation just after launch of a missile 15, and after the cover 10 has been removed. The wings of the missile 15 are unfolding making the missile 15 ready for flying. Prior to this, the cover 10 is quickly removed from the missile 15 by releasing the suspension in the front part 25 of the cover. The cover 10 will then quickly move downwards due to the force caused by air flow acting on it. The cover 10 will pivot around the axis of its suspension in the rear part 32. In this example the suspension is a hinge located at the rear end of the bottom part 30 of the cover 10.

The hinge mechanism can be made with an open slot such that when the cover 10 has rotated for instance 90 degree from its initial resting position, which is the position when it is mounted to the missile 15, it will drop out of the hinge 45 and quickly move away from the missile 15. This will ensure a secure removal of the cover 10 without coming in contact with the missile 15. In order to provide a more controlled movement out of the hinges 45, springs can be mounted in the hinges 45 for pushing the suspension means out of the hinge 45 when the cover 10 has rotated a certain degree from its initial resting position.

FIG. 6 illustrates a flying missile 15 after launch without the protecting cover 10. The wings 20 of the missile 15 are now fully unfolded and the air intakes 40 of the missile 15 are fully exposed.

FIGS. 7A-C show side views of a launched missile 15 and the different phases before and after the cover 10 is removed from the missile 15.

FIG. 7A illustrates a missile 15 with the protective cover 10 just after launch of the missile 15.

FIG. 7B illustrates the situation when the front part 25 of the cover 10 is released and the cover rotates in a controlled movement in the suspension means in the rear part 32 of the cover 10.

FIG. 7C illustrates the situation just after the cover has been fully removed from the missile 15. It will be guided away from the missile 15. The air intakes 40 will be exposed and the missile can start up its air breathing engine, e.g. jet motor.

The invention is further defined by a method for protecting a missile 15 with stowed wings 20 and air intakes 40.

The method comprises a first step of providing a cover 10 comprising a front part 25, a bottom part 30, a rear part 32 and suspension means, wherein said front part 25 is spoiler shaped and angled upwards relative to said bottom part 30, and where the front part 25 is shaped for covering a gap between the wings 20 and the fuselage of the missile 15. The next step is folding the wings 20 of the missile 15 in a stowed configuration alongside the missile 15 and in front of the air intakes 40. The last step is mounting the cover 10 on the missile 15 by means of the suspension means such that the front part 25 of the cover 10 is covering a gap between the wings 20 and the fuselage of the missile 15 thereby minimizing aerodynamic forces acting on the wings.

In one embodiment the method further comprises the step of fitting the wings 20 of the missile 15 into retention means 35 comprised in the cover 10 for holding the wings 20 in a stowed position alongside the missile 15.

In one embodiment the method further comprises the step of mounting the cover 10 over the air intake 40 on the missile making the cover 10 engage with the air intakes 40.

In one embodiment the method further comprises the step of removing the cover 10 after launching the missile 15, thus releasing the wings 20 and exposing the air intakes 40.

A safe and predictable removal of the cover 10 is achieved by first releasing the front part 25 of the cover 10, and then the rear part 32 of the cover 10. In this way the cover 10 will rotate around the rear part thereby assuring that the first part of the movement away from the missile 15 is strictly governed by the rear holding mechanism.

In one example, the front part 25 of the cover 10 is released first by a release mechanism 50. This can for instance be a forcing mechanism connected to a ball-lock mechanism 55 such that when the ball-lock releases the front part of the cover 10 will be released and swing downwards. After this the rear part 32 of the cover 10 will rotate in a hinges in the rear part 32, where the hinges have an open slot. This will assure that the first phase of the movement is away from the missile and strictly governed by the suspension means in the rear part 32 of the cover 10.

The present invention presents a space efficient way of protecting the wings 20 of a missile 15 such that vibration and movement will be minimized when these are stowed and exposed to strong air flow. The invention will further protect the air intake 40 of the jet engine of a missile 15.

The inventive cover 10 providing said protection is made such that it will be quickly removed in a safe way away from the missile 15.

The invention claimed is:

1. A cover (10) in combination with a missile (15), the cover (10) protecting the missile (15), the missile having a forward-most end, a rear-most end, and a mid-region located between the forward-most end and the rear-most end, the mid-region being provided with wings (20) in a folded and stowed position such that a line going from a root of the wings to a tip of the wings points downwards alongside an outer fuselage of the missile (15), wherein, with the wings in the folded and stowed position, the cover (10) encloses the tip of the wings, the cover (10) comprising:

a front part (25), and a bottom part (30), the front and bottom parts (25, 30) being angled relative to each other such that with the bottom part (30) positioned horizontally, the front part (25) is angled in a direction upwards from the bottom part, the bottom part (30) including a rear part (32), wherein with the wings (20) being in the folded and stowed position, a gap is present between the wings (20) and the fuselage, wherein the bottom part (30) further includes suspension means connecting the front part (25) and the rear part (32) of the cover (10) to the missile (15), and wherein, with the wings in the folded and stowed position, the bottom part (30) of the cover (10) encloses a distal end of the tip of the wings including opposite side edges of the distal end of the tip of the wings of the missile and the front part (25) of the cover (10) covers the gap present between the wings (20) and the fuselage of the missile (15), thereby reducing aerodynamic forces acting on the wings while in the folded and stowed position.

2. The cover (10) in combination with the missile, according to claim 1, the cover further comprising retention means (35) holding the wings (20) in the folded and stowed folded position alongside the missile (15), the retention means (35) comprising a slot (35) located at each of opposite edges of the bottom part (30) of the cover (10), wherein, with the cover (10) in an initial position with the wings in the folded and stowed position, each slot (35) encloses the distal end of the tip of one of the wings including the opposite side edges of the distal end of the tip to thereby reducing aerodynamic forces acting on the wings while in the folded and stowed position and exposed to air flow, and wherein, rotation of the cover away from the missile and out of the initial position, releases the tip of the wings from being enclosed by the slot (35) of the retention means.

3. The cover (10) in combination with the missile, according to claim 2, wherein the front part (25) is shaped such that air intakes (40) provided on the missile (15) are engaged with the cover (10) when the wings (20) are folded in front of the air intakes (40), the cover (10) covering and protecting the air intakes of the missile while leaving exterior surfaces of the forward-most end of the missile exposed to atmosphere.

4. The cover (10) in combination with the missile, according to claim 2, wherein the bottom part (30) of the cover (10) is made with a shape similar to the top side of an aircraft wing profile for generating aerodynamic forces acting downwards on the cover (10) relative to the missile (15).

5. The cover (10) in combination with the missile, according to claim 1, wherein the bottom part (30) of the cover (10) is made with a shape similar to the top side of an aircraft wing profile for generating aerodynamic forces acting downwards on the cover (10) relative to the missile (15).

6. The cover (10) in combination with the missile, according to claim 1, wherein the suspension means comprises at least one hinge (45) that is mounted at the rear part (32) of the bottom part (30) of the cover (10).

7. The cover (10) in combination with the missile, according to claim 6, wherein, the suspension means comprises a release mechanism (50) that when operated releases the cover (10) to swing downwards with the tip of the wings being released from the cover, the suspension means is arranged so that upon operation of the release mechanism (50), the front part (25) of the cover (10) is rotatable around the rear part (32) of the bottom part (30) so that upon release of the cover (10), the cover rotates around the rear part (32) of the bottom part (30) with the front part (25) of the cover (10) swinging downwards in a movement away from the missile, and wherein the at least one hinge (45) comprises an open slot for releasing the cover (10) when the cover rotates away from the missile (15).

8. The cover (10) in combination with the missile, according to claim 7, the cover further comprising a lock mechanism (55), wherein the release mechanism (50) is connected to the lock mechanism such that releasing the lock mechanism releases the front part (25) of the cover (10) so that the front part (25) of the cover (10) rotates around the rear part (32) of the bottom part (30) and the front part (25) of the cover (10) swings downwards in the movement away from the missile.

9. The cover (10) in combination with the missile, according to claim 1, wherein the cover (10) is made out of metal.

10. The cover (10) in combination with the missile, according to claim 1, wherein the cover (10) is made out of plastic.

11. The cover (10) in combination with the missile, according to claim 1, wherein the cover (10) is made out of carbon fiber.

12. The cover (10) in combination with the missile, according to claim 1, wherein the suspension means further comprises:

at least one hinge (45) located at the rear part (32) of the bottom part 30 of the cover (10), the at least one hinge (45) connecting the rear part (32) to the missile (15), and a ball-lock mechanism (55) located between the at least one hinge and the front part (25) of the cover (10), the ball-lock mechanism connecting the front part (25) of the cover (10) to the missile (15), wherein release of the ball-lock mechanism (55) releases the front part (25) of the cover (10) to swing downwards and rotate around the rear part (32) of the bottom part (30) in the movement away from the missile.

13. The cover (10) in combination with the missile, according to claim 12, wherein a release mechanism (50) of the suspension means is connected to the lock mechanism (55) so that upon operation of the release mechanism (50), the front part (25) is released and swings downwards.

14. The cover (10) in combination with the missile, according to claim 13, wherein the at least one hinge (45) and the release mechanism (50) are arranged so that upon operation of the release mechanism (50), after the front part (25) is released and swings downwards, the rear part (32) is released with the cover (10) rotating around the rear part (32) around the at least one hinge (45) and dropping out of the at least one hinge (45).

15. A method for protecting a missile (15) having a forward-most end, a rear-most end, and a mid-region located between the forward-most end and the rear-most end, the mid-region being provided with wings (20) that are foldable alongside an outer fuselage of the missile (15) making a gap between the wings (20) and the fuselage, the method comprising:

providing a cover (10), that with the wings in the folded and stowed position, encloses the tip of the wings, the cover (10) comprising: a front part (25), a bottom part (30) with a rear part (32), and suspension means located in the rear part (32), wherein said front part (25) of the cover (10) is angled in a direction upwards relative to the bottom part (30), and wherein the front part (25) is shaped for covering the gap made between folded wings (20) and the fuselage of the missile (15);

folding the wings (20) of the missile (15) alongside the fuselage of the missile (15), and mounting the cover (10) on the missile (15) by means of the suspension means such that the front part (25) of the cover (10) is covering air intakes (40) of the missile (15) and the gap between the folded wings (20) and the fuselage of the missile (15), and opposite edges of the bottom part (30) of the cover (10) enclose with a respective edge of the wings of the missile, thereby reducing aerodynamic forces acting on the wings while in the folded and stowed position and exposed to air flow.

16. The method according to claim 15, further comprising: fitting the wings (20) of the missile (15) into retention means (35) comprised in the cover (10) for holding the wings (20) in a folded position and stowed alongside the missile (15).

17. The method according to claim 15, wherein, when the wings (20) are in an initial position with the wings in the folded and stowed position, the cover (10) covers and protects the air intakes of the missile while leaving exterior surfaces of the forward-most end of the missile exposed to atmosphere, the method further comprising: removing the cover (10) after launching the missile (15), thus releasing the wings (20), including the tip of the wings from being enclosed by the cover, and exposing the air intakes (40).

18. The method according to claim 17, wherein the cover (10) is removed by first releasing the front part (25) of the cover (10) by a release mechanism (50) of the suspension means, and secondly the rear part (32) letting the cover (10) rotate in a hinged rear part (45) with an open slot thereby assuring that a first phase of the movement is away from the missile and strictly governed by the suspension means in the rear part (32) of the cover (10).

* * * * *